US010063950B2

(12) United States Patent
Schädler

(10) Patent No.: US 10,063,950 B2
(45) Date of Patent: Aug. 28, 2018

(54) SOUND GENERATOR SYSTEM FOR A MOTOR VEHICLE

(71) Applicant: TENNECO GMBH, Edenkoben (DE)

(72) Inventor: Bernd Schädler, Edenkoben (DE)

(73) Assignee: TENNECO GMBH, Edenkoben (DE)

( * ) Notice: Subject to any disclaimer, the term of this patent is extended or adjusted under 35 U.S.C. 154(b) by 30 days.

(21) Appl. No.: 14/607,554

(22) Filed: Jan. 28, 2015

(65) Prior Publication Data

US 2015/0230012 A1 Aug. 13, 2015

(30) Foreign Application Priority Data

Feb. 13, 2014 (DE) ..... 10 2014 101 826

(51) Int. Cl.

| | |
|---|---|
| ***H04R 1/02*** | (2006.01) |
| ***F01N 1/06*** | (2006.01) |
| ***G10K 9/13*** | (2006.01) |
| ***G10K 11/178*** | (2006.01) |
| ***G10K 11/22*** | (2006.01) |

(52) U.S. Cl.

CPC ..... *H04R 1/02* (2013.01); *F01N 1/065* (2013.01); *G10K 9/13* (2013.01); *G10K 11/178* (2013.01); *G10K 11/22* (2013.01); *G10K 2210/129* (2013.01); *G10K 2210/1282* (2013.01); *H04R 1/028* (2013.01); *H04R 2499/13* (2013.01)

(58) Field of Classification Search

CPC ..... H04R 1/02; H04R 2499/13; H04R 1/028; G10K 11/16; G10K 11/175; G10K 11/178; G10K 11/1788; G10K 2210/12822; G10K 9/13; G10K 11/22; G10K 2210/1282; G10K 2210/129; F01N 1/065; F01N 13/007; F01N 13/08; F01N 13/082; F01N 13/008

USPC ..... 381/71.4, 71.5, 86, 338; 181/206, 227, 181/228, 250

See application file for complete search history.

(56) References Cited

U.S. PATENT DOCUMENTS 5,119,902 A 6/1992 Geddes
5,550,334 A * 8/1996 Langley ..... F16L 55/0333 181/206
5,693,918 A * 12/1997 Bremigan ..... F01N 1/065 181/206

(Continued)

FOREIGN PATENT DOCUMENTS

DE 10193139 T1 7/2003
DE 10 2012 023 643 A1 6/2013

(Continued)

*Primary Examiner* — Jason R Kurr
(74) *Attorney, Agent, or Firm* — Hudak, Shunk & Farine Co. LPA

(57) ABSTRACT

A sound generator system for motor vehicles having a housing having a central axis, the housing at least partially delimiting a sound chamber, and having at least one loudspeaker located inside the housing, wherein a first sound-conducting connecting piece having a central axis M1 is acoustically coupled to the housing, the first sound-conducting connecting piece extending the sound chamber in a direction R1 along the central axis M1. At least one second sound-conducting connecting piece having a central axis M2 is acoustically coupled to the housing, the second sound-conducting connecting piece extending the sound chamber in a direction R2 along the central axis M2, wherein direction R1 differs from direction R2.

20 Claims, 2 Drawing Sheets

(56) References Cited

U.S. PATENT DOCUMENTS

| | | | | |
|---|---|---|---|---|
| 5,822,439 | A * | 10/1998 | Sakiyama | B60R 19/48 381/71.1 |
| 9,206,717 | B2 * | 12/2015 | Kruger | F01N 13/1888 |
| 2005/0163334 | A1 * | 7/2005 | Suprapmo | H04R 1/2826 381/337 |
| 2007/0205043 | A1 * | 9/2007 | Krueger | F01N 1/065 181/206 |
| 2014/0376733 | A1 * | 12/2014 | Pommerer | H04R 3/002 381/71.4 |

FOREIGN PATENT DOCUMENTS

| | | | |
|---|---|---|---|
| EP | 2 108 791 | B1 | 12/2010 |
| JP | S6022010 | A | 2/1985 |
| JP | 7-248783 | A | 9/1995 |
| JP | 2008106671 | A | 5/2008 |

* cited by examiner

SOUND GENERATOR SYSTEM FOR A MOTOR VEHICLE

FIELD OF THE INVENTION

The invention relates to a sound generator system for motor vehicles having a housing comprising a central axis, said housing at least partially delimiting a sound chamber, and having at least one loudspeaker located inside the housing, wherein a first sound-conducting connecting piece having a central axis M1 and an orifice is acoustically coupled to the housing, said first sound-conducting connecting piece extending the sound chamber in a direction R1 such as, for example, into the rear of a vehicle along the central axis M1 towards the orifice.

BACKGROUND OF THE INVENTION

EP 2 108 791 B1 has already disclosed an active silencer for an exhaust system of a motor vehicle comprising a multi-shell housing having a pot-shaped top shell and a pot-shaped bottom shell, a funnel-shaped sound-conducting body which is inserted into the bottom shell and has a connection passing through the bottom shell and out of the housing, a loudspeaker which is situated in the top shell and a bypass through which an interior space of the top shell is connected to an interior space of the bottom shell so they communicate.

A sound generator system for a vehicle having an acoustic line to connect the sound generator system to the body of the vehicle, so that an acoustic signal from the acoustic line is emitted directly to the exterior or to the interior of the vehicle is known from DE 10 2012 023 643 A1.

A system to reduce motor vehicle noise is known from JP 2008106671A. The system comprises a housing having a loudspeaker located therein, wherein two sound-conducting connecting pieces are connected to the housing, which both conduct the sound into the rear of the vehicle and/or acoustically couple and/or decouple the rear of the vehicle.

DE 101 93 139 T1 describes a device for the active reduction of low noises. In this system, a housing is acoustically coupled with a loudspeaker by means of the top wall of the silencer and/or a common opening between the silencer housing and the loudspeaker housing. The sound is conducted to the rear of the vehicle by means of the silencer housing which is open towards the rear.

JP 600 22 010 A discloses a similar system in which a loudspeaker housing is acoustically coupled by means of a sound-conducting connecting piece with a silencer housing which is open towards the rear and/or tailpipe housing.

SUMMARY OF THE INVENTION

The object of the invention is to configure and locate a sound generator system such that an optimum coupling to the environment is guaranteed.

The object is achieved according to the invention in that at least one second sound-conducting connecting piece having a central axis M2 and an orifice is acoustically coupled, said second sound-conducting connecting piece extending the sound chamber in a direction R2 along the central axis M2 towards the orifice such as, for example, into the front vehicle area of the engine, with direction R1 differing from direction R2 and/or direction R1 of the rear orifice and direction R2 of the front orifice enclosing an angle of at least 30°.

This ensures that the sound to be generated starting from the in this respect dot-like and/or individual sound source can be transmitted into different areas of the vehicle such as, for example, into the rear and the front area.

To this end, it may also be advantageous if direction R1 and direction R2 enclose an angle $\alpha$ where $30° <= \alpha <= 180°$. The angle should be at least 30°, in order to couple different areas of the motor vehicle acoustically and/or provide them with sound, if possible. At an angle of 180°, opposite areas of the motor vehicle such as the front and rear or the right and left sides can be acoustically coupled.

In addition, it may be advantageous if at least a first opening is provided inside the housing, to which opening the first sound-conducting connecting piece and/or the second sound-conducting connecting piece is/are connected. It is basically possible to connect the respective sound-conducting connecting piece to a separate opening of the housing or to also connect a plurality of sound-conducting connecting pieces to one opening. Moreover, it is possible to assign a plurality of openings to one sound-conducting connecting piece, e.g. in the form of a perforation zone.

It may also be advantageous if the housing has a housing wall, said housing wall having at least one first perforation zone P1. The perforation zone P1 is provided at a distance from the sound-conducting connecting piece, therefore it is not part of the sound-conducting connecting piece or part of the acoustic connection of the same. In addition, areas of the motor vehicle such as, for example, the underfloor can be acoustically coupled via the perforation zone P1.

The perforation zone P1 is provided at a distance from the sound-conducting connecting piece, is therefore not part of the sound-conducting connecting piece or integrated therein. In addition, areas of the motor vehicle such as, for example, the underfloor can be acoustically coupled via the perforation zone P1.

The perforation zone 1 is a zone of the housing wall which is provided with at least one notch or recess by means of which the sound can escape undampened. In addition, the sound is, in any case, emitted via the housing wall, but the latter is in a more dampened form than is the case via the perforation zone P1.

It may be more advantageous that the housing wall comprises a second perforation zone P2, wherein the second perforation zone P2 is located opposite the first perforation zone P1. The second perforation zone P2 is also located at a distance from the sound-conducting connecting piece so that other areas below the motor vehicle can be acoustically coupled to the sound generator system.

Due to the opposing arrangement the sound can, for example, be emitted to the underfloor of the motor vehicle and to the road. Alternatively or additionally, for example, the sound can be emitted towards the left and the right sides.

It may be of particular importance to this invention if at least a further sound-conducting connecting piece is provided inside the housing wall and/or at least one additional sound-conducting connecting piece is provided at the first sound-conducting connecting piece and/or at the second sound-conducting connecting piece. It is therefore possible to acoustically couple other areas below the motor vehicle.

The sound impression of the acoustic coupling largely depends on the coupling point and the form of the sound-conducting medium used such as, for example, a sound-conducting pipe.

The object is also achieved by a motor vehicle having a longitudinal vehicle axis A1 and an underfloor with a sound generator system as described above, wherein direction R1 of the first sound-conducting connecting piece extends rearwards with respect to the longitudinal vehicle axis A1 and/or towards the rear of the motor vehicle and/or direction R2 of the second sound-conducting connecting piece extends forwards with respect to the longitudinal vehicle axis A1 and/or towards the front of the motor vehicle, wherein the rear area of the exhaust pipes and the front area are coupled acoustically via the respective orifice. The area of the exhaust tailpipes and the engine area located at the front can therefore be coupled acoustically. Of course this applies analogously to electrically operated motor vehicles.

It may, in addition, be advantageous if the housing is located below the underfloor, wherein the first perforation zone P1 is located in an area of the housing wall facing the underfloor and/or the second perforation zone P2 is located in an area of the housing wall facing away from the underfloor. The sound can therefore be emitted towards the underfloor of the motor vehicle and, at the same time, towards the road.

In addition, it may be advantageous if at least one sound-conducting connecting piece is acoustically coupled/connected to the underfloor, wherein a coupling pipe can be provided between the underfloor and the sound-conducting connecting piece. The acoustic coupling is preferably effected by the coupling pipe located between the sound-conducting connecting piece and the underfloor, the length of said coupling pipe can be adjusted for assembly purposes. This pipe connection can be formed by a coupling pipe which is closed or at least perforated at the end, which is connected positively or non-positively to the housing and/or the underfloor, so that the sound wave entering the pipe is transmitted to the underfloor. The connecting pipe can have an extremely wide range of embodiments, in particular as regards the length, cross section, area, wall thickness and/or wall structure. A coupling pipe formed from shells is also provided, for example.

It may be advantageous if the coupling to the underfloor is effected by means of a flexible coupling member, which prevents the transfer of at least, in part, undefined vibrations of the sound generator system to the underfloor. Any possible resonance effects to which the housing is subjected should not be acoustically coupled to the underfloor.

It may furthermore be advantageous if the sound-conducting connecting piece is routed via a recess A2 through the underfloor. This is associated with a substantially more direct acoustic coupling of the interior of the motor vehicle. Alternatively, the same effect can also be achieved by routing the coupling pipe via a recess A2 through the underfloor.

Finally, it may be advantageous if the housing is at least partially integrated into the underfloor. The housing is integrated at least in terms of its form, i.e. the housing and the underfloor comprise a common adjustment zone A3, inside which the housing and the underfloor are adjusted in terms of their form. The distance between the housing and the underfloor is reduced, on the one hand, by the geometric adjustment. On the other hand, the corresponding coupling surface is increased, so that the acoustic coupling is improved in total. A further integration can be formed by the sound-conducting connecting piece or sound-conducting channels connected thereto, which extend in or on the underfloor.

In addition, a sound generator system and/or a motor vehicle in which one exhaust pipe having an orifice is connected to at least one sound-conducting connecting piece may be advantageous. An exhaust pipe is therefore connected acoustically in each case, so that the position of the respective orifice can be varied accordingly. The exhaust pipes can also have different lengths and/or shapes. The respective orifice zone determines the part of the motor vehicle which is acoustically coupled to the sound generator system. In the case of electric vehicles these are conducting pipes which do not conduct any exhaust gas.

BRIEF DESCRIPTION OF THE DRAWINGS

Further advantages and details of the invention will be explained in the claims and in the specification and illustrated in the figures, where

DETAILED DESCRIPTION OF THE INVENTION

Figure 1:
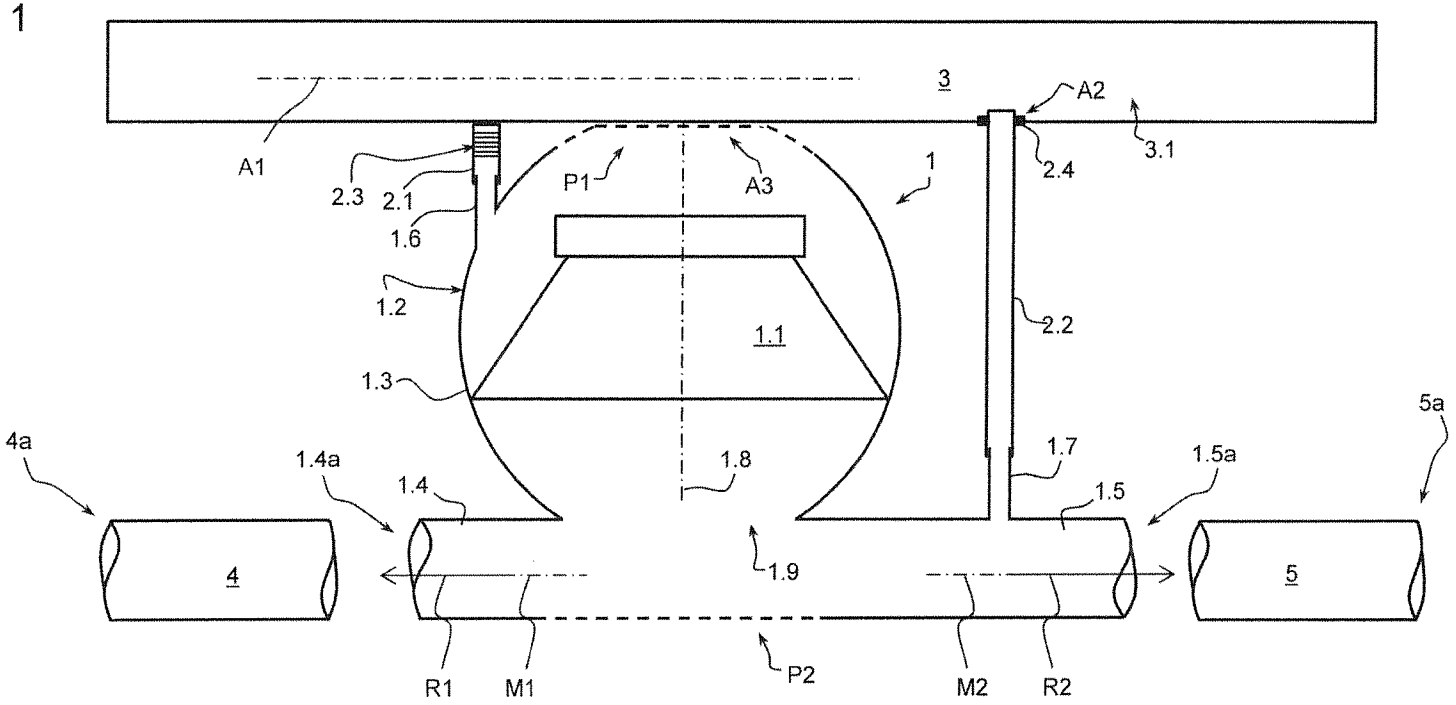
FIG. 1 shows a schematic diagram of the sound generator system in a lateral view.

A sound generator system 1 according to FIG. 1 is formed from a housing 1.2 having a loudspeaker 1.1 located inside a housing wall 1.3. Directly connected to the housing 1.2 and/or the housing wall 1.3 are various sound-conducting connecting pieces 1.4, 1.5, 1.6, 1.7, which serve to transmit the sound waves generated by the loudspeaker to the environment, on the one hand, and to an underfloor 3.1 of a motor vehicle 3.

The sound waves are transmitted in a direction R1 with respect to a longitudinal vehicle axis A1 forwards towards the orifice 1.4*a* via the sound-conducting connecting piece 1.4, with the latter being transmitted, if desired, by a guiding pipe 4 to the orifice 4*a*, which can also be configured as an exhaust pipe.

Accordingly, the sound waves are conducted via the sound-conducting connecting piece 1.5 in a direction R2 towards an orifice 1.5*a* towards the rear of a vehicle, if necessary also using a guiding pipe 5, towards the orifice 5*a*.

The sound generator system 1 shown here is connected to a motor vehicle 3, and/or to a motor vehicle underfloor 3.1. The housing 1.2 and/or an interior of the housing 1.2 is/are acoustically coupled to the underfloor 3.1 by means of the sound-conducting connecting piece 1.6. To this end, a coupling pipe 2.1 having a flexible connection 2.3 such as, for example, a corrugated hose and/or a metal bellows is provided on the end of the sound-conducting connecting piece 1.6. Other vibrations of the housing 1.2 are decoupled by means of the connection 2.3. The coupling pipe 2.1 and/or the connection 2.3 is/are positively or non-positively connected to the underfloor 3.1.

The sound-conducting connecting piece 1.7 is connected to the sound-conducting connecting piece 1.5 and connects the latter via a coupling pipe 2.2 to the underfloor 3.1. A recess A2 is provided inside the underfloor 3.1, through which the coupling pipe 2.2 is inserted through the underfloor 3.1. For the purposes of decoupling the aforementioned vibrations and for sealing purposes, a damping element 2.4, which is not shown further, is provided between the coupling pipe 2.2 and the underfloor 3.1.

Figure 2:
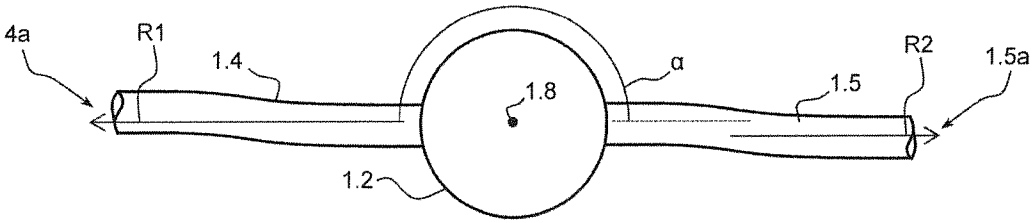
FIG. 2 shows a schematic diagram of the sound generator system in a view from above.

According to FIG. 2, both sound-conducting connecting pieces 1.4, 1.5 extend in opposing directions R1, R2. The two directions R1, R2 enclose an angle $\alpha$ of 180° with respect to a central axis 1.8 of the housing 1.2. The same applies to the position of the orifices 1.4*a*, 1.5*a* and/or those towards orifices 4*a*, 5*a*. When defining the respective direction R1, R2 it does not come down to any curvatures or deviations of the sound-conducting connecting piece. Rather, it is the overall alignment of the respective direction R1, R2, therefore the position of the orifices 1.4*a*, 1.5*a*, 4*a*, 5*a*, which is important.

A perforation zone P1 of the housing wall 1.3 is provided as a further means for acoustic coupling, said perforation zone P1 being positioned on the side of the housing 1.2 facing the underfloor 3.1. In addition, the housing wall 1.3 has an adjustment zone A3 in this area, inside which the form of the housing wall 1.3 and the form of the underfloor 3.1 correspond. This therefore guarantees a larger area, within which as small a distance as possible exists between the housing wall 1.3 and the underfloor 3.1.

In order to improve the sound impression of the sound generator system 1, a further perforation zone P2 is provided on the bottom side, via which the sound waves generated by the loudspeaker 1.1 are emitted, in an amplified manner, to the environment in the direction of a contact area of the vehicle.

Figure 3:
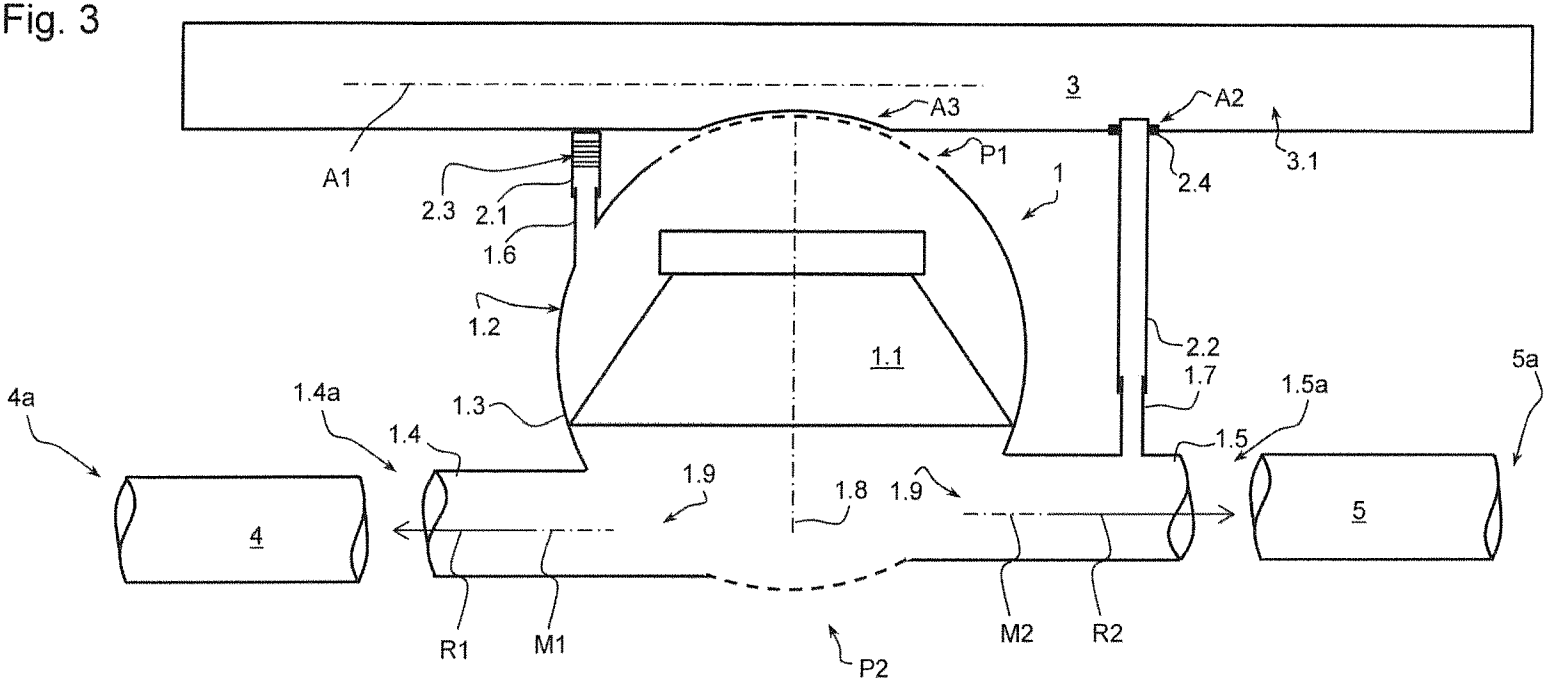
FIG. 3 shows a schematic diagram according to FIG. 1 with a modified adjustment zone A3.

The two sound-conducting connecting pieces 1.4, 1.5 are connected to a common opening 1.9 of the housing wall 1.3. According to FIG. 3, it is also possible to provide a separate opening 1.9 inside the housing wall for each sound-conducting connecting piece 1.4, 1.5.

In addition, it is possible to generate the adjustment zone A3 by means of a corresponding geometry of the underfloor 3.1.

LIST OF REFERENCE NUMERALS

1 Sound generator system
1.1 Loudspeaker
1.2 Housing
1.3 Housing wall
1.4 First sound-conducting connecting piece
1.5 Second sound-conducting connecting piece
1.6 Additional sound-conducting connecting piece
1.7 Additional sound-conducting connecting piece
1.8 Central axis
1.9 Opening
2.1 Coupling pipe
2.2 Coupling pipe
2.3 Flexible connection, corrugated hose, metal bellows
2.4 Attenuator
3 Motor vehicle
3.1 Underfloor
4 Guiding pipe, exhaust pipe
5 Guiding pipe, exhaust pipe
α Angle
A1 Longitudinal vehicle axis
A2 Recess, hole
A3 Adjustment zone
M1 Central axis
M2 Central axis
P1 Perforation zone
P2 Perforation zone
R1 Direction
R2 Direction

What is claimed is:

1. A sound generator system for motor vehicles, comprising: a housing comprising a central axis, said housing at least partially delimiting a sound chamber and having at least one loudspeaker located inside the housing, wherein a first sound-conducting connecting piece having a central axis M1 is acoustically coupled to the housing and having a first orifice for the sound, said first sound-conducting connecting piece extending the sound chamber in a direction R1 along the central axis M1 towards the first orifice that transmits sound into a rear area of the motor vehicle, wherein at least one second sound-conducting connecting piece having a central axis M2 is acoustically coupled to the housing and having a second orifice for the sound, said second sound-conducting connecting piece extending the sound chamber in a direction R2 along the central axis M2 towards the second orifice that transmits sound into a front area of the motor vehicle, wherein direction R1 of the first orifice differs from direction R2 of the second orifice, wherein a first pipe is connected to the first sound-conducting connecting piece and a second pipe is connected to the second sound-conducting connecting piece, and wherein the housing is neither directly nor indirectly by any pipe coupled to an engine of the motor vehicle insofar that exhaust is conducted by said any pipe.

2. The sound generator system according to claim 1, wherein direction R1 and direction R2 enclose an angle α, where $30° <= \alpha <= 180°$.

3. The sound generator system according to claim 2, wherein at least a first opening is provided inside the housing, to which opening the first sound-conducting connecting piece and/or the second sound-conducting connecting piece is/are connected.

4. The sound generator system according to claim 3, wherein the housing comprises a housing wall, wherein the housing wall comprises at least a first perforation zone P1.

5. The sound generator system according to claim 4, wherein the housing wall comprises a second perforation zone P2, wherein the second perforation zone P2 is located opposite the first perforation zone P1.

6. The sound generator system according to claim 5, wherein at least one additional sound-conducting connecting piece is provided inside the housing wall and/or that at least one additional sound-conducting connecting piece is provided at the first sound-conducting connecting piece and/or at the second sound-conducting connecting piece.

7. The sound generator system according to claim 1, wherein at least a first opening is provided inside the housing, to which opening the first sound-conducting connecting piece and/or the second sound-conducting connecting piece is/are connected.

8. The sound generator system according to claim 1, wherein the housing comprises a housing wall, wherein the housing wall comprises at least a first perforation zone P1.

9. The sound generator system according to claim 8, wherein the housing wall comprises a second perforation zone P2, wherein the second perforation zone P2 is located opposite the first perforation zone P1.

10. The sound generator system according to claim 1, wherein at least one additional sound-conducting connecting piece is provided inside the housing wall and/or that at least one additional sound-conducting connecting piece is provided at the first sound-conducting connecting piece and/or at the second sound-conducting connecting piece.

11. A motor vehicle having a longitudinal vehicle axis A1 and an underfloor with a sound generator system according to claim 1, wherein direction R1 of the first sound-conducting connecting piece extends rearwards with respect to the longitudinal vehicle axis A1 and/or direction R2 of the second sound-conducting connecting piece extends forwards with respect to the longitudinal vehicle axis A1 , wherein a rear area of exhaust pipes and a front area are acoustically coupled by the respective first and second orifices.

12. The motor vehicle according to claim 11, wherein the housing is located below the underfloor, wherein a first perforation zone P1 is located in an area of the housing wall facing the underfloor and/or a second perforation zone P2 is located in an area of the housing wall facing away from the underfloor.

13. The motor vehicle according to claim 11, wherein at least one sound-conducting connecting piece is acoustically coupled/connected to the underfloor, wherein a coupling pipe can be provided between the underfloor and the sound-conducting connecting piece.

14. The motor vehicle according to claim 13, wherein a coupling to the underfloor is effected by means of a flexible coupling member which at least reduces a transmission of the vibrations of the sound generator system to the underfloor.

15. The motor vehicle according to claim 14, wherein the sound-conducting connecting piece is routed via a recess A2 through the underfloor.

16. The motor vehicle according to claim 15, wherein the housing, at least in terms of its form, is at least partially integrated into the underfloor.

17. The motor vehicle according to claim 11, wherein a coupling to the underfloor is effected by means of a flexible coupling member which at least reduces a transmission of the vibrations of the sound generator system to the underfloor.

18. The motor vehicle according to claim 11, wherein the sound-conducting connecting piece is routed via a recess A2 through the underfloor.

19. The motor vehicle according to claim 11, wherein the housing, at least in terms of its form, is at least partially integrated into the underfloor.

20. The sound generator system according to claim 1 wherein a guiding pipe having an orifice is connected to at least one sound-conducting connecting piece.

* * * * *